US005947086A

United States Patent [19]

Hoshino et al.

[11] Patent Number: 5,947,086

[45] Date of Patent: Sep. 7, 1999

[54] THROTTLE VALVE CONTROL APPARATUS

[75] Inventors: Masatoshi Hoshino, Tsuchiura; Nobuo Kurihara, Hitachiota; Katsuji Marumoto, Hitachi, all of Japan

[73] Assignee: Hitachi, Ltd., Japan

[21] Appl. No.: 08/954,200

[22] Filed: Oct. 20, 1997

[30] Foreign Application Priority Data

Oct. 18, 1996 [JP] Japan ..... 8-275839

[51] Int. Cl.[6] ..... F02D 11/10

[52] U.S. Cl. ..... 123/399; 123/396; 123/397

[58] Field of Search ..... 123/339.25, 399, 123/396, 397

[56] References Cited

U.S. PATENT DOCUMENTS

| | | | |
|---|---|---|---|
| 5,062,404 | 11/1991 | Scotson et al. | 123/399 |
| 5,400,756 | 3/1995 | Mentgen | 123/399 |
| 5,606,950 | 3/1997 | Fujiwara et al. | 123/399 |
| 5,640,943 | 6/1997 | Tasaka et al. | 123/399 |

FOREIGN PATENT DOCUMENTS

| | | |
|---|---|---|
| 59-188050 | 10/1984 | Japan . |
| 63-147947 | 6/1988 | Japan . |
| 63-258231 | 10/1988 | Japan . |
| 64-77726 | 3/1989 | Japan . |

*Primary Examiner*—Erick R. Solis
*Attorney, Agent, or Firm*—Evenson, McKeown, Edwards & Lenahan, P.L.L.C.

[57] ABSTRACT

It is an object to improve the opening control resolving power in the case where the opening/closing of a throttle valve is controlled by a motor driven actuator. An additional control signal for finely vibrating the throttle valve is given to the actuator in a specific period until the opening of the throttle valve approaches its target value. Consequently, the throttle valve vibrates finely only as occasion demands. Accordingly, in spite of the fact that the opening of the throttle valve can be controlled with finer control resolving power than ordinary control resolving power, good response can be obtained as a whole.

12 Claims, 6 Drawing Sheets

| No. | PRESENCE OF DITHER (Y) | ABSENCE OF DITHER (N) |
|---|---|---|
| 1 | $a < \lvert \theta_r - \theta \rvert$ | $\lvert \theta_r - \theta \rvert < b$ |
| 2 | $a < \lvert \theta_r - \theta \rvert$ AND $\lvert \Delta \theta \rvert < b$ | $\lvert \theta_r - \theta \rvert < c$ AND $\lvert \Delta \theta \rvert < d$ |

THROTTLE VALVE CONTROL APPARATUS

BACKGROUND OF THE INVENTION

1. Field of the Invention

The present invention relates to a technique for electronically controlling a throttle in an internal combustion engine mounted on a car, or the like.

2. Description of the Related Art

In an electronically controlled throttle apparatus for controlling a throttle valve by means of a motor, the quantity of intake air of an engine can be controlled taking into account the condition of the engine obtained from respective sensors as well as the quantity of depression of an accelerator pedal. Accordingly, the electronically controlled throttle apparatus may be used widely for traction control, idling rotational speed control, auto-cruise, lean-burn air-fuel ratio control, etc.

As the control performance required for the use for the aforementioned object, it is said that the response time from the full-open state of a throttle valve to the full-close state of the same is not longer than about 100 ms and the resolving power is about 0.05 degrees. A large number of control systems satisfying these conditions have been discussed in JP-A-63-147947, JP-A-59-188050, JP-A-63-258231 and JP-A-64-77726. For example, JP-A-63-147947 discloses an electronically controlled throttle apparatus using a stepping motor. That is, this JP-A-63-147947 discloses a system in which dither is used to equivalently improve the mechanical resolving power of the stepping motor which is determined depending on the number of poles and gear ratio of the stepping motor.

If the throttle is to be moved very finely upon the assumption of idling rotational speed control, however, hunting may occur in the throttle valve in the vicinity of a target opening in case of depending only on an ordinary feedback control system such as PID control, or the like. This phenomenon is largely affected by nonlinearity caused by static friction in the throttle valve, the motor for driving the throttle valve, and the rotation shaft of reduction gears connecting the throttle valve and the motor to each other. If a large torque is applied to a stationary valve so as to move the valve, the opening exceeds the target value so that a large torque must be applied again reversely.

In such a case, dither can be used to give fine vibration onto the throttle valve to thereby suppress the effect of static friction. It is not preferable to give vibration always to the throttle valve from the point of view of durability. When the motor is a DC motor with brushes, abrasion of the brush causes a problem. When the throttle valve opening sensor is a contact type potentiometer, there is a possibility that no sensor output is obtained because of the abrasion of the contact surface of the potentiometer.

SUMMARY OF THE INVENTION

An object of the present invention is to solve the aforementioned problems, that is, to provide an electronic throttle control apparatus in which the resolving power of the quantity of intake air can be improved and the idling rotational speed can be controlled.

To achieve the foregoing object, according to a first aspect of the present invention, there is provided a throttle valve control apparatus comprising a throttle valve attached to an air-intake pipe, a throttle valve drive means, an opening measurement means for measuring an opening of the throttle valve, and a control signal calculation means for calculating a control signal on the basis of a signal from the opening measurement means and supplying the control signal to the throttle valve drive means to thereby drive the throttle valve, wherein when the difference between an actual opening and a target opening of the throttle valve is within a predetermined range, the control signal calculation means calculates a first control signal for moving the throttle valve toward the target opening and a second control signal for finely vibrating the throttle valve on the basis of the signal from the opening measurement means and supplies the sum of the first and second control signals to the throttle valve drive means to thereby move the throttle valve toward the target opening with high resolving power.

According to a second aspect of the present invention, there is provided a throttle valve control apparatus comprising a throttle valve attached to an air-intake pipe, a throttle valve drive means, an opening measurement means for measuring an opening of the throttle valve, and a control signal calculation means for calculating a control signal on the basis of a signal from the opening measurement means and supplying the control signal to the throttle valve drive means to thereby drive the throttle valve, wherein when the difference between an actual opening and a target opening of the throttle valve is within a predetermined range, and the absolute value of the opening change per unit time of the throttle valve is not larger than a predetermined value, the control signal calculation means calculates a first control signal for moving the throttle valve toward the target opening and a second control signal for finely vibrating the throttle valve on the basis of the signal from the opening measurement means and supplies the sum of the first and second control signals to the throttle valve drive means to thereby move the throttle valve toward the target opening with high resolving power.

According to a third aspect of the present invention, in the throttle valve control apparatus according to the first and second aspect of the invention, when the difference between the actual opening and target opening of the throttle valve is within a predetermined range, the second control signal for vibrating the throttle valve finely is stopped.

According to a fourth aspect of the present invention, in the throttle valve control apparatus according to any one of the first, second and third aspects of the invention, when a position measurement means is provided as a contact type position sensor mounted on a rotation shaft of the throttle valve or on a rotation shaft of a gear interlocked with the throttle valve, the fine vibration of the throttle valve is restricted within a range in which a brush of the contact type position sensor is bent but the contact surface of the brush does not move.

According to a fifth aspect of the present invention, in the throttle valve control apparatus according to any one of the first, second and third aspects of the invention, when the throttle valve drive means is constituted by a motor in which a rotor and stator are electrically connected to each other through a brush, the fine vibration of the throttle valve is restricted within a range in which a brush of the contact type position sensor is bent but the contact surface of the brush does not move.

According to a sixth aspect of the present invention, in the throttle valve control apparatus according to any one of the first, second and third aspects of the invention, when the throttle valve drive means which generates torque in proportion to a current like a DC motor is controlled on the basis of the duty of PWM, the second control signal for vibrating the throttle valve finely is corrected on the basis of the ratio of a source voltage of the throttle valve drive means to a reference source voltage so that an amplitude of the fine vibration of the throttle valve is kept to be a predetermined value even if the source voltage changes.

According to a seventh aspect of the present invention, in the throttle valve control apparatus according to any one of the first, second and third aspects of the invention, when torque generated in the throttle valve drive means is proportional to a current like a DC motor, the throttle valve control apparatus further comprises a current measurement means in which the second control signal for vibrating the throttle valve finely is corrected on the basis of the current flowing in the throttle valve drive means and a voltage applied to the throttle valve drive means so that an amplitude of the fine vibration of the throttle valve is kept to be a predetermined value even if an inner resistance of the throttle valve drive means changes due to a change of temperature.

According to an eighth aspect of the present invention, in the throttle valve control apparatus according to any one of the first, second and third aspects of the invention, when torque generated in the throttle valve drive means is proportional to a current like a DC motor, the throttle valve control apparatus further comprises a current control means for supplying a predetermined current to the throttle valve drive means, whereby the control signal calculation means designates an amplitude of the fine vibration of the throttle valve in terms of the torque so that an amplitude of the fine vibration of the throttle valve is kept to be a predetermined value even if a source voltage and atmospheric temperature change.

According to a ninth aspect of the present invention, in the throttle valve control apparatus according to any one of the first, second and third aspects of the invention, when the apparatus includes a processing integrating a difference between the actual opening and target opening of the throttle valve in a process in which the control signal calculation means calculates the control signals on the basis of a signal obtained by a position measurement means, and when the second control signal for vibrating the throttle valve finely is stopped, the processing of integrating the difference between the actual opening and target opening of the throttle valve is stopped so that the integrated valve does not change.

DESCRIPTION OF THE PREFERRED EMBODIMENT

Figure 2:
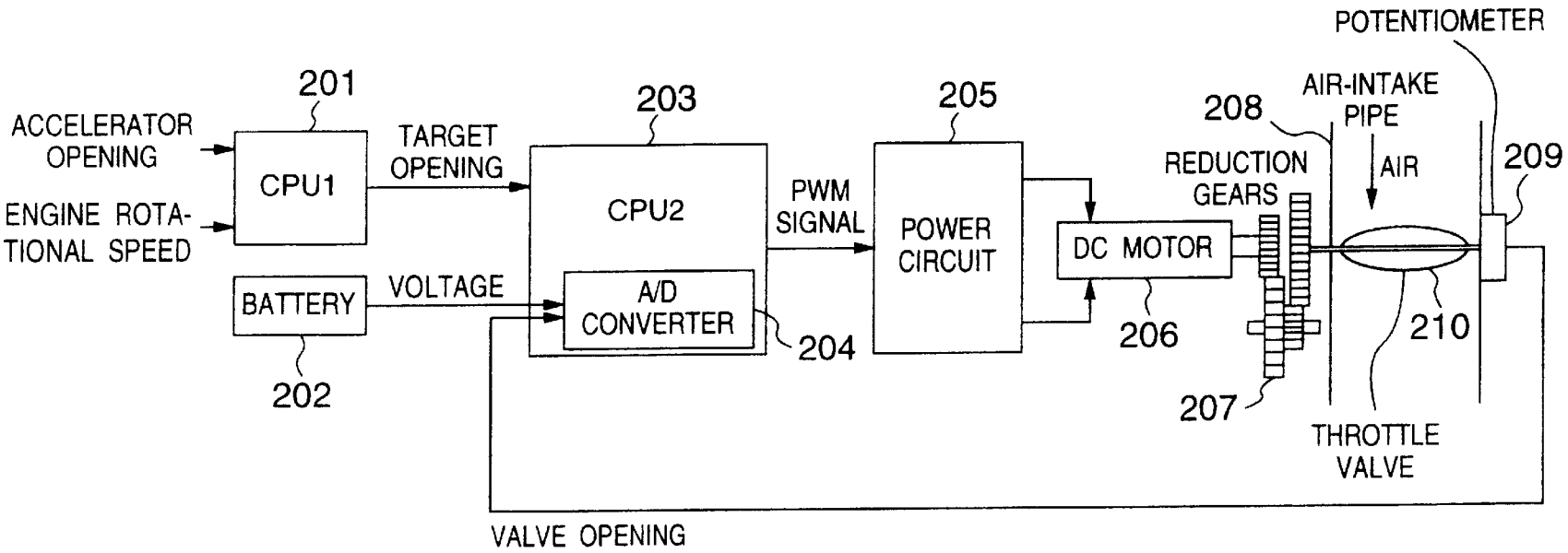
FIG. 2 is a schematic block diagram showing an electronically controlled throttle apparatus.

An embodiment of the present invention will be described below with reference to the drawings. FIG. 2 schematically shows a throttle control apparatus. A first microcomputer 201 determines a target opening of a throttle valve 210 on the basis of the quantity of depression of an accelerator pedal, the rotational speed of an engine, and so on, and transfers the target opening to a second microcomputer 203. The second microcomputer 203 generates a PWM signal on the basis of the target opening of the throttle valve and a valve opening obtained by A/D conversion 204 of the output of a potentiometer 209 provided on a rotation shaft of the throttle valve. The second microcomputer 203 drives a DC motor 206 through a power circuit 205 on the basis of the PWM signal so as to make the actual opening of the throttle valve reach the target opening.

The DC motor is connected to the throttle valve mounted on an air-intake pipe 208 of the engine through reduction gears 207. To correct the PWM signal, a voltage of a battery 202 is A/D-converted so as to be used in the second microcomputer 203.

Figure 1:
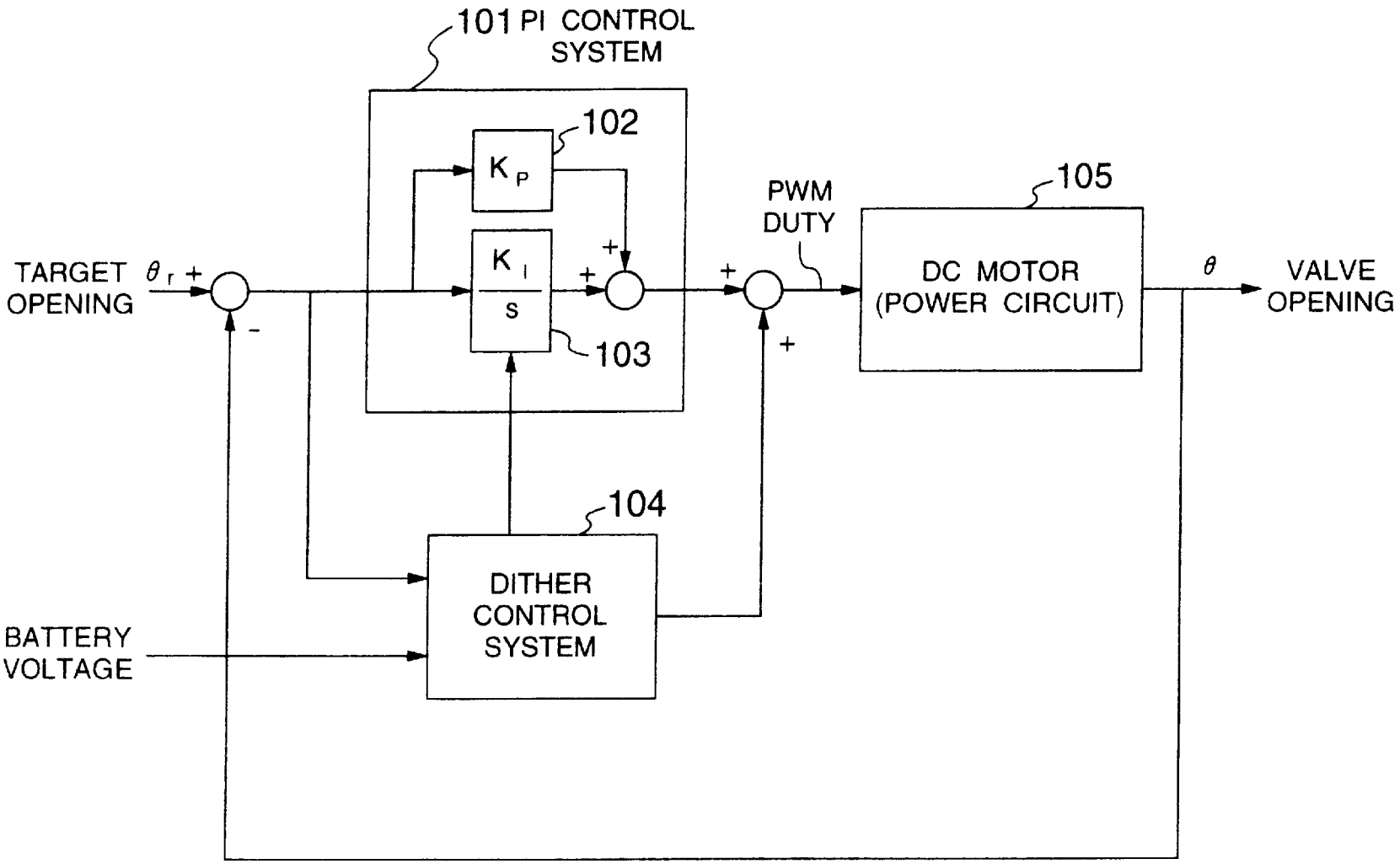
FIG. 1 is a schematic block diagram showing a control system in the throttle valve control apparatus according to the present invention.
Figure 3:
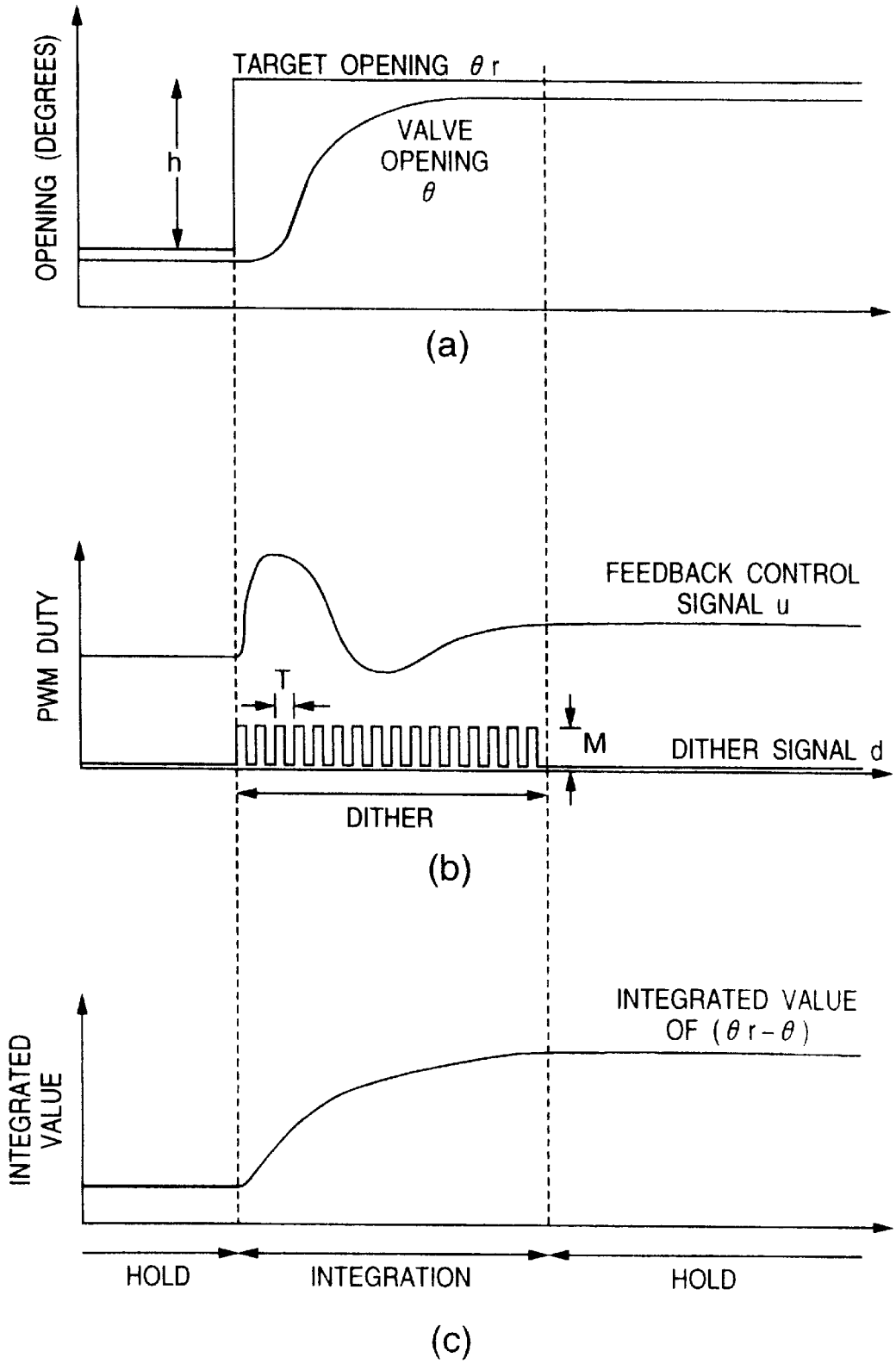
FIG. 3 is graph showing the valve opening, the control signal and the integrated value of the difference between the target opening and the valve opening with the passage of time in the case where the apparatus according to the present invention is used while the target opening of the throttle valve changes step by step in order to control the idling rotational speed.
Figures 4, 5:
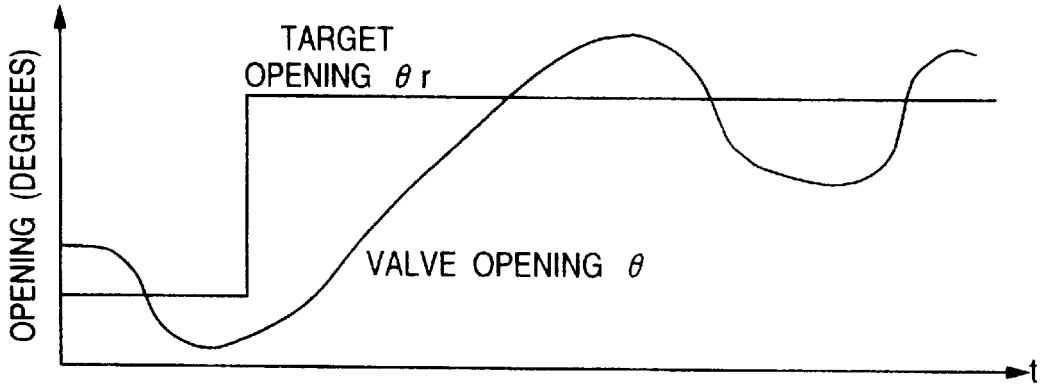
FIG. 4 is a graph showing the valve opening with the passage of time in the case where a conventional control apparatus is used.
FIG. 5 is a table showing conditions for starting or terminating the fine vibration given to the throttle valve.

The present invention relates to the operation of the second microcomputer substantially controlling the throttle valve in the aforementioned throttle control apparatus. The operation will be described below with reference to FIG. 1. The duty of the PWM signal supplied to the DC motor 105 is the sum of the output of a PI control system 101 and the output of a dither control system 104. The PI control system is a control system which outputs, as a feedback control signal, the sum of a value 102 obtained by multiplying the difference between the opening of the throttle valve and the target opening of the same by a constant KP and a value 103 obtained by integrating the product obtained by multiplying the above-mentioned difference by a constant KI. If the throttle is an ideal electronically controlled throttle which is little affected by static friction, the throttle valve can be controlled only by the PI control system. Practically, however, dither is used because the resolving power cannot be secured particularly when the change of the throttle opening is small. The dither control system outputs a dither signal on the basis of the battery voltage and the difference between the actual opening of the throttle valve and the target opening of the same. The dither signal is designed so that the duty of the PWM signal is changed in the form of rectangular wave in order to vibrate the throttle valve finely. FIG. 3(*a*) shows the response in the case where the target opening changes stepwise. Assuming the idling rotational speed control necessary for the resolving power of the intake air quantity, then the step width h may be not larger than 0.1 degree. FIG. 4 shows the response characteristic of the throttle valve in the case where only the PI control system is used. In FIG. 4, hunting due to static friction occurs, so that the resolving power cannot be obtained. FIG. 3(*a*) shows characteristic in the case where dither control is used. In FIG. 3(*a*), the throttle opening approaches the target opening. FIG. 3(*b*) shows the feedback signal obtained in the PI control system and a dither signal which is the output of the dither control system. The PWM duty supplied to the DC motor is the sum of those two signals.

To use dither always is not preferable from the point of view of durability of a mechanical system. It is therefore necessary to contrive the timing of use of dither and the amplitude of the fine vibration of the throttle valve. When the actual throttle valve opening θ approaches the target value θr sufficiently to an extent that the opening error gives no influence on the rotational speed of the engine as indicated by No. 1 in FIG. 5, dither is stopped. If dither is stopped at the point of time when the actual throttle valve opening approaches the target value sufficiently, the throttle valve becomes stationary. When the target value changes so that the opening error increases sufficiently, dither is restarted to rotate the throttle valve. If the throttle valve moves at a sufficient speed, there is little influence of static friction. Accordingly, it is also effective that not only the condition that the throttle valve opening θ approaches the target value θr sufficiently but also the condition that the valve is stationary or moves at a sufficiently low speed Δθ is added to the condition for starting dither as indicated by No. 2 in FIG. 5. The speed Δθ is calculated on the basis of the valve opening difference measured by the potentiometer. In such a manner, the valve can be vibrated finely only in the case where it is necessary to move the throttle valve, so that the influence on durability is reduced.

Figure 6A:
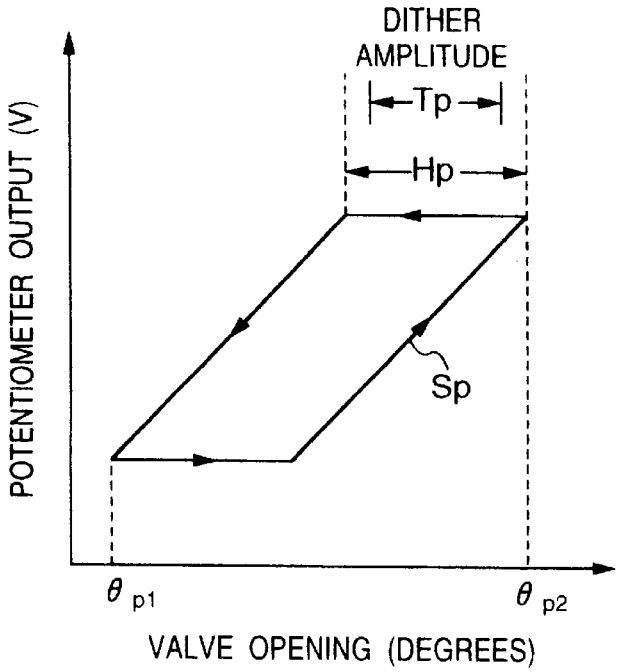
FIGS. 6A and 6B are graphs showing the output of a potentiometer and the position of an end of a brush of a DC motor in the case where the throttle valve is opened and closed at a constant opening width.
Figure 6B:
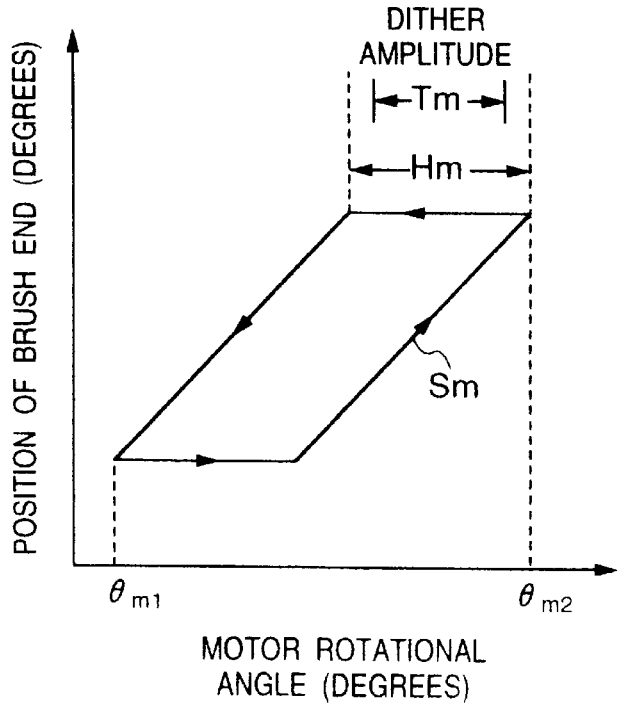

Further, a dither system using hysteresis of a potentiometer or DC motor to make both the durability of the throttle and the dither be consistent with each other will be described below. When the throttle valve opening is opened/closed from $\theta_{p1}$ to $\theta_{p2}$ as shown in FIG. 6A, the relation between the valve opening and the output of the potentiometer mounted on the rotation shaft of the throttle valve exhibits a characteristic of an insensitive zone Sp. The theory of the potentiometer is such that a brush directly connected to the rotation shaft is brought into contact with a resistor stuck to a body so that the opening is measured on the basis of the resistance value. In this case, the hysteresis between the rotation shaft and the brush causes such an insensitive zone Hp. There is also more or less hysteresis between the rotation shaft of the DC motor and the brush of the same (FIG. 6B). Accordingly, even in the case where the DC motor rotates, there is a region Hm in which the contact surface of the brush does not move. In this region, deterioration due to abrasion of the brush hardly occurs because the contact surfaces of the brush of the potentiometer and the brush of the DC motor do not move even in the case where the opening of the throttle valve changes. Accordingly, taking into account the durability of the DC motor and potentiometer, it will do to determine the amplitude M and period T of the dither signal so that the vibration of the throttle valve due to dither is within a range Tp in the insensitive zone Hp of the potentiometer and within a range Tm in the insensitive zone Hm of the brush of the DC motor.

In this embodiment, the amplitude M of the dither signal is designated in terms of the duty ratio because the DC motor is controlled by the PWM duty. In this case, the current flowing in the motor on the basis of the dither signal varies in accordance with the voltage Vb of the battery. In order to keep the current based on the dither signal constant, the amplitude M of the dither signal is corrected on the basis of the ratio of the reference battery voltage V0 to the actual battery voltage Vb.

To make the throttle valve follow the target opening, at least one integrator is generally required in the inside of a control system. Also in this embodiment, at least one integrator is provided because the PI control system is employed as shown in FIG. 2. When the opening error of the throttle valve becomes sufficiently small, addition of the dither signal is stopped by the aforementioned dither control. At this time, the valve becomes stationary in most cases because of the influence of the static friction. If the opening error remains even slightly, however, the integrator integrates the difference between the target opening and the actual valve opening so that the output of the control system increases with the passage of time. Then, when torque larger than the static friction is generated, the throttle valve begins to move in spite of the fact that the opening error is sufficiently small so that the opening error is made larger instead. To prevent this disadvantage, when the dither signal is stopped, the integrating calculation in the PI control system is stopped so that the integrated value is kept unchanged (FIG. 3(*c*)).

Figure 7:
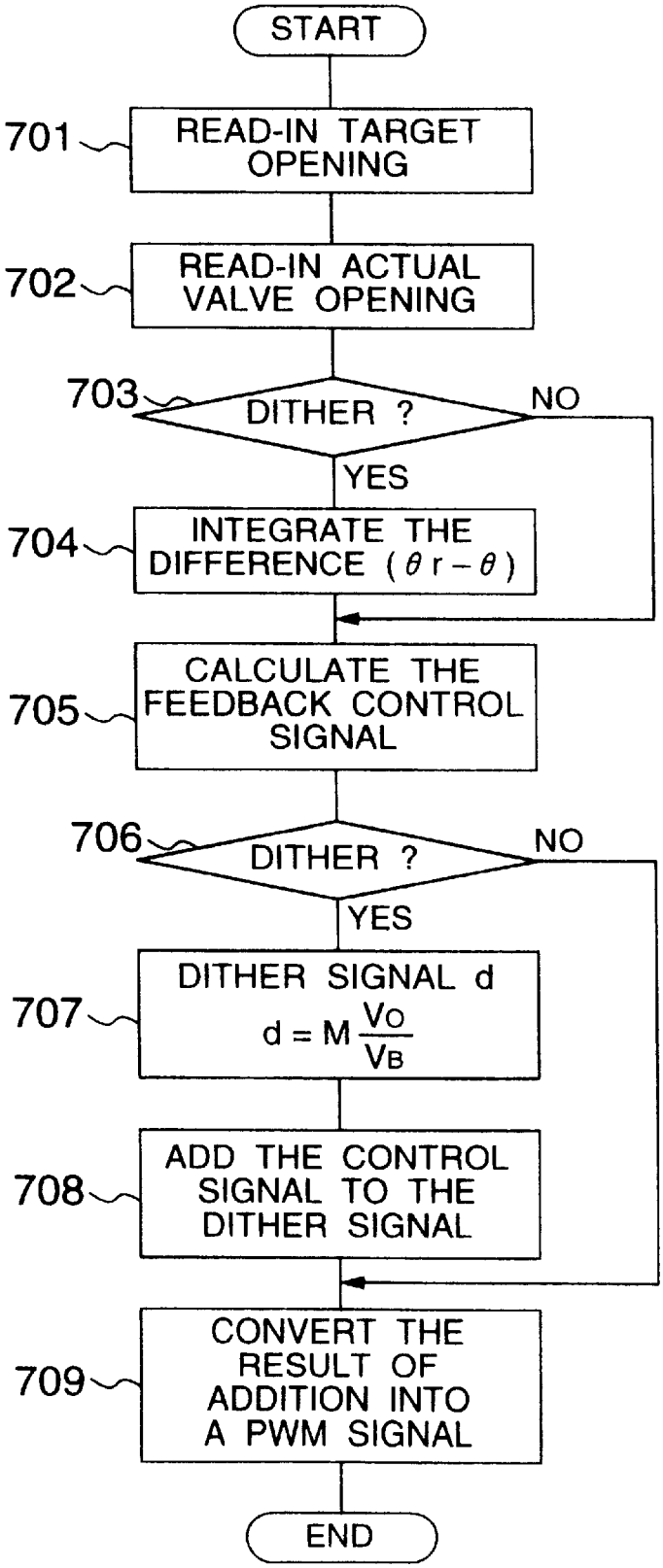
FIG. 7 is a flow chart showing the content of control used in the throttle valve control apparatus according to the present invention.

The aforementioned control system can be expressed by such a flow chart as shown in FIG. 7. First, the target opening and actual valve opening of the throttle valve are read (701, 702). The difference between the target opening and the actual valve opening and the speed of the valve are calculated on the basis of the target opening and actual valve opening of the throttle valve, so that a judgment is made on the basis of FIG. 5 as to whether dither is to be used or not (703). If dither is required to be used, a value obtained by multiplying the difference between the target opening and the actual valve opening by the integration gain KI is integrated (704). Further, the output of the integrator is added to a value obtained by multiplying the difference between the target opening and the actual valve opening by the proportion gain KP, so that a feedback control signal is obtained (705). When dither is required to be used (706), the amplitude M of the dither signal which is preliminary determined so that the throttle valve vibrates finely in the hysteresis range of the potentiometer or DC motor is corrected on the basis of the ratio of the battery voltage Vb to the reference voltage V0 (707). Then, the feedback control signal and the dither signal are added up (708). Finally, a result of the addition is converted into a PWM signal (709) to thereby drive the DC motor. This procedure is repeated to control the throttle valve.

In the control system according to the present invention, the improvement of the control resolving power can be achieved without giving any influence onto the response speed of the throttle valve. Accordingly, idling rotational speed control based on the throttle valve can be performed. Further, according to the present invention, the increase of cost can be minimized because the resolving power is improved by the control system without requiring any change of the shape of the air-intake pipe or any improvement of the throttle valve and the rotation shaft of the motor. Because not only the fine vibration of the throttle valve is limited only in the case where the valve is required to be moved but also the fine vibration is restricted within the insensitive zones of the contact portions of the vibrating amplitude potentiometer and DC motor, the fine vibration hardly gives bad influence on the durability of the throttle mechanical system. A general servo system using an integrator and a dither system according to the present invention can be used consistently as a system for controlling the opening of the throttle valve without giving any bad influence on the tracking performance of the servo system.

What is claimed is:

1. A throttle valve control apparatus comprising a throttle valve attached to an air-intake pipe, a throttle valve drive means, am opening measurement means for measuring an opening of said throttle valve, and a control signal calculation means for calculating a control signal on the basis of a signal from said opening measurement means and supplying said control signal to said throttle valve drive means to thereby drive said throttle valve, wherein only when the difference between an actual opening and a target opening of said throttle valve is within a first predetermined range, said control signal calculation means calculates a first control signal for moving said throttle valve toward said target opening and a second control signal for finely vibrating said throttle valve on the basis of said signal from said opening measurement means and supplies the sum of said first and second control signals to said throttle valve drive means to thereby move said throttle valve toward said target opening with high resolving power.

2. A throttle valve control apparatus according to claim 1, wherein when the difference between said actual opening and target opening of said throttle valve is within a second predetermined range, said second control signal for vibrating said throttle valve finely is stopped.

3. A throttle valve control apparatus comprising a throttle valve attached to an air-intake pipe, a throttle valve drive means, an opening measurement means for measuring an opening of said throttle valve, and a control signal calculation means for calculating a control signal on the basis of a signal from said opening measurement means and supplying said control signal to said throttle valve drive means to thereby drive said throttle valve, wherein only when the difference between an actual opening and a target opening of said throttle valve is within a predetermined range, and the absolute value of the opening change per unit time of said throttle valve is not larger than a predetermined value, said control signal calculation means calculates a first control signal for moving said throttle valve toward said target opening and a second control signal for finely vibrating said throttle valve on the basis of said signal from said opening measurement means and supplies the sum of said first and second control signals to said throttle valve drive means to thereby move said throttle valve toward said target opening with high resolving power.

4. A throttle valve control apparatus comprising a throttle valve attached to an air-intake pipe, a throttle valve drive means, an opening measurement means for measuring an opening of said throttle valve, and a control signal calculation means for calculating a control signal on the basis of a signal from said opening measurement means and supplying said control signal to said throttle valve drive means to thereby drive said throttle valve, wherein when the difference between an actual opening and a target opening of said throttle valve is within a predetermined range, said control signal calculation means calculates a first control signal for moving said throttle valve toward said target opening and a second control signal for finely vibrating said throttle valve on the basis of said signal from said opening measurement means and supplies the sum of said first and second control signals to said throttle valve drive means to thereby move said throttle valve toward said target opening with high resolving power;

a position measurement means is provided as a contact type position sensor mounted on one of a rotation shaft of said throttle valve and a rotation shaft of a gear interlocked with said throttle valve; and the fine vibration of said throttle valve is restricted within a range in which a brush of said contact type position sensor is bent but the contact surface of said brush does not move.

5. A throttle valve control apparatus comprising a throttle valve attached to an air-intake pipe, a throttle valve drive means, an opening measurement means for measuring an opening of said throttle valve, and a control signal calculation means for calculating a control signal on the basis of a signal from said opening measurement means and supplying said control signal to said throttle valve drive means to thereby drive said throttle valve, wherein when the difference between an actual opening and a target opening of said throttle valve is within a predetermined range, said control signal calculation means calculates a first control signal for moving said throttle valve toward said target opening and a second control signal for finely vibrating said throttle valve on the basis of said signal from said opening measurement means and supplies the sum of said first and second control signals to said throttle valve drive means to thereby move said throttle valve toward said target opening with high resolving power;

said throttle valve drive means comprises a motor having a rotor and stator electrically connected to each other through a brush; and the fine vibration of said throttle valve is restricted within a range in which a brush of said contact type position sensor is bent but the contact surface of said brush does not move.

6. A throttle valve control apparatus comprising a throttle valve attached to an air-intake pipe, a throttle valve drive means, an opening measurement means for measuring an opening of said throttle valve, and a control signal calculation means for calculating a control signal on the basis of a signal from said opening measurement means and supplying said control signal to said throttle valve drive means to thereby drive said throttle valve, wherein when the difference between an actual opening and a target opening of said throttle valve is within a predetermined range, said control signal calculation means calculates a first control signal for moving said throttle valve toward said target opening and a second control signal for finely vibrating said throttle valve on the basis of said signal from said opening measurement means and supplies the sum of said first and second control signals to said throttle valve drive means to thereby move said throttle valve toward said target opening with high resolving power;

said throttle valve drive means generates torque in proportion to a current, and is controlled on the basis of the duty of a PWM signal; and said second control signal for vibrating said throttle valve finely is corrected on the basis of the ratio of a source voltage of said throttle valve drive means to a reference source voltage, so that an amplitude of the fine vibration of said throttle valve is maintained at a predetermined value, even if said source voltage changes.

7. A throttle valve control apparatus comprising a throttle valve attached to an air-intake pipe, a throttle valve drive means, an opening measurement means for measuring an opening of said throttle valve, and a control signal calculation means for calculating a control signal on the basis of a signal from said opening measurement means and supplying said control signal to said throttle valve drive means to thereby drive said throttle valve, wherein when the difference between an actual opening and a target opening of said throttle valve is within a predetermined range, said control signal calculation means calculates a first control signal for moving said throttle valve toward said target opening and a second control signal for finely vibrating said throttle valve on the basis of said signal from said opening measurement means and supplies the sum of said first and second control signals to said throttle valve drive means to thereby move said throttle valve toward said target opening with high resolving power;

a torque generated in said throttle valve drive means is proportional to a current; and said throttle valve control apparatus further comprises a current measurement means in which said second control signal for vibrating said throttle valve finely is corrected on the basis of said current flowing in said throttle valve drive means and a voltage applied to said throttle valve drive means so that an amplitude of the fine vibration of said throttle valve is maintained at a predetermined value, even if an inner resistance of said throttle valve drive means changes due to a change of temperature.

8. A throttle valve control apparatus comprising a throttle valve attached to an air-intake pipe, a throttle valve drive means, an opening measurement means for measuring an opening of said throttle valve, and a control signal calculation means for calculating a control signal on the basis of a signal from said opening measurement means and supplying said control signal to said throttle valve drive means to thereby drive said throttle valve, wherein when the difference between an actual opening and a target opening of said throttle valve is within a predetermined range, said control signal calculation means calculates a first control signal for moving said throttle valve toward said target opening and a second control signal for finely vibrating said throttle valve on the basis of said signal from said opening measurement means and supplies the sum of said first and second control signals to said throttle valve drive means to thereby move said throttle valve toward said target opening with high resolving power;

torque generated in said throttle valve drive means is proportional to a current; and said throttle valve control apparatus further comprises a current control means for supplying a predetermined current to said throttle valve drive means, whereby said control signal calculation means designates an amplitude of the fine vibration of said throttle valve in terms of the torque so that an amplitude of the fine vibration of said throttle valve is maintained at a predetermined value, even if a source voltage and atmospheric temperature change.

9. A throttle valve control apparatus comprising a throttle valve attached to an air-intake pipe, a throttle valve drive means, an opening measurement means for measuring an opening of said throttle valve, and a control signal calculation means for calculating a control signal on the basis of a signal from said opening measurement means and supplying said control signal to said throttle valve drive means to thereby drive said throttle valve, wherein when the difference between an actual opening and a target opening of said throttle valve is within a predetermined range, said control signal calculation means calculates a first control signal for moving said throttle valve toward said target opening and a second control signal for finely vibrating said throttle valve on the basis of said signal from said opening measurement means and supplies the sum of said first and second control signals to said throttle valve drive means to thereby move said throttle valve toward said target opening with high resolving power;

said apparatus includes a processing integrating a difference between the actual opening and target opening of said throttle valve in a process in which said control signal calculation means calculates said control signals on the basis of a signal obtained by a position measurement means; and when said second control signal for vibrating said throttle valve finely is stopped, the processing of integrating the difference between said actual opening and target opening of said throttle valve is stopped, so that the integrated valve does not change.

10. A method for operating a throttle valve control apparatus having a throttle valve attached to an air-intake pipe, a throttle valve drive unit, an opening measurement means for measuring an opening of said throttle valve, and a control signal calculation means for calculating a control signal on the basis of a signal from said opening measurement means and supplying said control signal to said throttle valve drive unit to thereby drive said throttle valve; said method comprising:

detecting when a difference between an actual opening and a target opening of said throttle valve is within a first predetermined range;

said control signal calculation means calculating a first control signal for moving said throttle valve toward said target opening;

in response to a detection that said difference is within said first predetermined range, said control signal calculation means calculating a second control signal for finely vibrating said throttle valve; and supplying a sum of said first and second control signals to said throttle valve drive unit to thereby move said throttle valve toward said target opening with high resolving power.

11. A method for operating a throttle valve control apparatus having a throttle valve attached to an air-intake pipe, a throttle valve drive unit, an opening measurement means for measuring an opening of said throttle valve, and a control signal calculation means for calculating a control signal on the basis of a signal from said opening measurement means and supplying said control signal to said throttle valve drive unit to thereby drive said throttle valve; said method comprising:

detecting when a difference between an actual opening and a target opening of said throttle valve is within a first predetermined range, and the absolute value of the opening change per unit time of said throttle valve is not larger than a predetermined value;

said control signal calculation means calculating a first control signal for moving said throttle valve toward said target opening;

in response to a detection that said difference is within said first predetermined range and said absolute value is not larger than said predetermined value, said control signal calculation means calculating a second control signal for finely vibrating said throttle valve; and supplying the sum of said first and second control signals to said throttle valve drive means to thereby move said throttle valve toward said target opening with high resolving power.

12. A throttle valve control apparatus according to claim 10, wherein when the difference between said actual opening and target opening of said throttle valve is within a second predetermined range, said second control signal for finely vibrating said throttle valve is stopped.

* * * * *